US005727694A

United States Patent [19]

Larson

[11] Patent Number: 5,727,694

[45] Date of Patent: Mar. 17, 1998

[54] HAT HOLDER

[76] Inventor: James Duane Larson, P.O. Box 972, Vashon, Wash. 98070

[21] Appl. No.: 763,661

[22] Filed: Dec. 11, 1996

[51] Int. Cl.[6] ..... A47G 25/10

[52] U.S. Cl. ..... 211/33; 211/30; D6/455; D6/457

[58] Field of Search ..... 24/26, 30, 31, 24/32, 33; 206/8, 9; 211/85.2; D6/455, 457, 458, 468, 469, 462

[56] References Cited

U.S. PATENT DOCUMENTS

| | | | |
|---|---|---|---|
| 406,673 | 7/1889 | Seymour | 206/9 |
| 461,827 | 10/1891 | Ferry | 206/9 |
| 2,409,484 | 10/1946 | Gauthier | 211/26 X |
| 2,494,487 | 1/1950 | Pfeil | 206/9 X |
| 4,805,782 | 2/1989 | Hale et al. | 211/30 |
| 4,993,557 | 2/1991 | Davis | 211/30 |
| 5,197,612 | 3/1993 | Thomson | 211/30 |
| 5,344,003 | 9/1994 | Park | 206/8 |
| 5,396,994 | 3/1995 | Fitzgerald | 211/30 X |
| 5,411,144 | 5/1995 | Deupree | 211/30 |
| 5,480,073 | 1/1996 | LaManna | 211/30 |

*Primary Examiner*—Blair Johnson

*Attorney, Agent, or Firm*—Joseph H. McGlynn; Patent and Trademark Serivces, Inc.

[57] ABSTRACT

A stand for supporting a conventional baseball-style cap consisting of a hole in the stand. The hole is circular in shape, with linear horizontal extensions. A plurality of the holes can be set in a self-supporting stand, thereby allowing caps to be stored or displayed in the stands.

9 Claims, 1 Drawing Sheet

FIG. 1
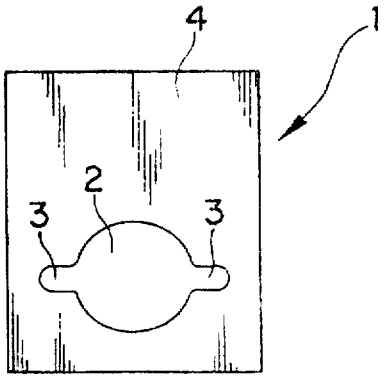
FIG. 2
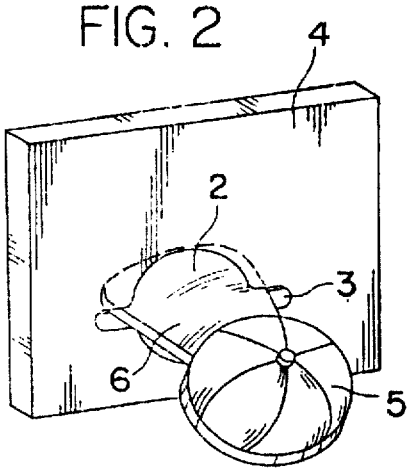
FIG. 3
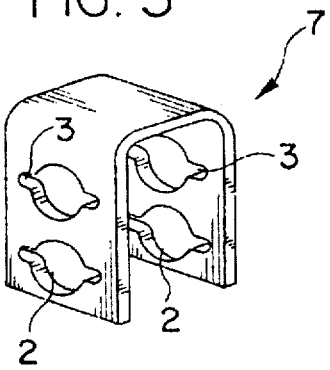
FIG. 4
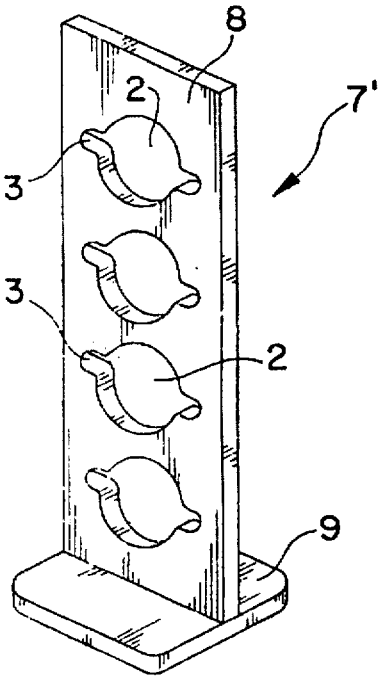
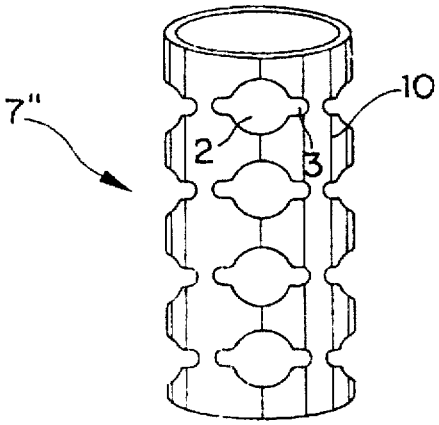
FIG. 5

HAT HOLDER

BACKGROUND OF THE INVENTION

This invention relates generally to storage items and, more particularly, to storage items for conventional caps.

DESCRIPTION OF THE PRIOR ART

Numerous inventions relating to storage devices for caps and bottles have been proposed in the prior art. Often, they seek to allow storage by creating a free standing device with a mechanism that can grip and hold a cap or bottle. U.S. Pat. No. 5,197,612 discloses a freestanding bottle stand. The edges of crossing legs of rectangular cross section have interfitting notches for holding the legs in approximately perpendicular relationship to form an X-shaped bipod bottle stand, and such legs have through them apertures for receiving the necks of bottles to support the bottles in cantilever fashion.

U.S. Pat. No. 5,411,144 discloses a cap rack in the form of an elongated bar. The elongated bar is placed in a substantially vertical orientation and includes a laterally ventral portion which extends forward with respect to the lateral side edges. A laterally extending slot extends through the rack for each cap to be retained therein.

U.S. Pat. No. 5,480,073 discloses a cap holder apparatus including a case assembly adapted to be attached to a support surface. A plurality of clamp members project from the top surface of the base assembly. Each of the clamp members includes a round contour adapted to contact a round contour on a head covering such as a cap or hat.

U.S. Pat. No. 4,993,557 discloses cap storing devices, particularly a stand for supporting a plurality of caps of the type having a deformable crown and an extended visor. The stand includes a base and an upstanding back, together with a curvate shelf which engages the inner periphery of a folded crown, while the cap visor extends vertically in engagement with the back. A plurality of folded caps thus may be stacked one upon the other in storage mode.

Most of the prior art devices have allowed cap storage only by means of a complicated assembly process of a gripping mechanism. There remains a need for a device which allows storage of caps while utilizing the convenience of freestanding bottle racks.

SUMMARY OF THE INVENTION

The present invention comprises a device for supporting a conventional cap in a stand consisting of a hole in a stand mechanism. The hole is circular in shape, with linear horizontal extensions. A plurality of holes is set in a self-supporting stand, thereby allowing caps to be stored or displayed in the stands. The shape and size of the stands may vary.

Accordingly, it is an object of this invention to provide a device for storage of caps.

It is a further object of this invention to provide a device for storage of caps into which the caps may be easily inserted.

Finally, it is an object of this invention to provide a device for storage of caps in a self-supporting stand.

BRIEF DESCRIPTION OF THE DRAWINGS

FIG. 1 shows a plan view of the present invention.

FIG. 2 shows the present invention with a cap inserted.

FIG. 3 shows another embodiment of the present invention.

FIG. 4 shows another embodiment of the present invention.

FIG. 5 shows another embodiment of the present invention.

DESCRIPTION OF THE PREFERRED EMBODIMENT

Referring now to the drawings, there is shown in FIG. 1 the present invention 1 comprising a hole 2, of a nearly circular shape, set in a piece of material 4. On opposite sides of hole 2 are linear extensions 3 which are oriented in a collinear position. In use (as shown in FIG. 2), a cap 5 is folded so that the brim 6 may be inserted into the hole 2 so that the brim 6 of the cap 5 fits partially into the linear extensions 3 of the hole 2.

The material of the element 4 can be any material such as, but not limited to, wood, plastic or cardboard. In addition, the number of apertures 2 can be varied to allow the invention to hold a single cap, as shown in FIGS. 1, 2 or a plurality of caps, as shown in FIGS. 3–5.

FIGS. 3 through 5 show some of the ways that the device 1 may be positioned as a self-supporting stands 7, 7', 7". Any number of copies of the device 1, consisting of the hole 2 and linear extensions 3, may be provided in the stands 7, 7', 7", so that a plurality of caps may be stored in the device. In embodiments of the stand 7" wherein the design of the stand 7" may allow caps to come in contact with one another, such as in FIG. 5, care should be taken to assure that enough space is left between holes 2 in the interior of the stand 7" so as to allow all holes 2 to be filled with caps. In addition the apertures 2 could be staggered so the bills 6 of the caps 5 do not interfere with each other as they are mounted into the stand.

The device of FIG. 3 is a U-shaped stand which is self-supporting. However, it should be understood that the "U-shape" is not the only shape that could be used to make the stand self-supporting. Other shapes such as, but not limited to, a V-shape could also be used.

The stand of FIG. 4 has a vertical portion 8 connected to a horizontal support platform 9 by any conventional means. The vertical portion 8 can be made as a separate piece and then connected to the horizontal support platform 9, or the two parts can be made unitary.

FIG. 5 shows the stand 7" made into a cylinder 10 which has a plurality of the apertures 2 positioned around the circumference of the cylinder.

The composition of the stand may be of any material which readily holds its shape and therefore allows the form of the storage holes 2 to be maintained. A material such as wood or plastic would be ideal, though many other materials may be acceptable. Furthermore, it is to be understood that while many forms and shapes of the device and stand have been presented herein, it is to be understood that the concept of the storage hole, 2, 3 may be applied to any other shape while still being included within the scope of this invention. Also, the exact size and shape of the holes 2, 3 may be varied to hold caps of different sizes and shapes.

Although the cap storage device and the method of using the same according to the present invention have been described in the foregoing specification with considerable detail, it is to be understood that modifications may be made to the invention which do not exceed the scope of the appended claims, and modified forms of the present invention done by others skilled in the art to which the invention pertains will be considered infringements of the invention when those modified forms fall within the claimed scope of this invention.

What I claim as my invention is:

1. A support for the removable storage of baseball-style caps, each of said caps having a generally half-spherical body adapted to fit onto a person's head and a bill portion extending from the half-spherical body, said support comprising:

a substantially rigid member having a length and a width, and a first surface and a second surface, at least one circular aperture extending through said first and second surfaces, each said circular aperture having a pair of slots extending substantially equally from said circular aperture in diametrically opposite directions, said pair of slots communicating with said circular aperture, and wherein said substantially rigid member is in a cylindrical shape, whereby said bill portion of said cap may be inserted into said pair of slots in order to mount said cap in said support.

2. The support for the removable storage of baseball-style caps as claimed in claim 1, wherein said substantially rigid member is U-shaped.

3. The support for the removable storage of baseball-style caps as claimed in claim 1, wherein said substantially rigid member is a vertical, planar member, and a horizontal support member is attached to said vertical member.

4. The support for the removable storage of baseball-style caps as claimed in claim 3, wherein said vertical and horizontal members are unitary.

5. A support for the removable storage of baseball-style caps, in combination with at least one of said baseball-style caps comprising:

each of said baseball-style caps having a generally half-spherical body adapted to fit onto a person's head and a generally planar bill portion extending from the half-spherical body, said support comprising:

a substantially rigid member having a length, a width, and a thickness, and a first surface and a second surface, said surfaces defining a plane, at least one circular aperture extending through said first and second surfaces, each said circular aperture having a pair of slots extending from said circular aperture in diametrically opposite directions, each of said slots having a length, a width and a thickness, said pair of slots communicating with said circular aperture, and said generally planar bill portion is engaged in said slots with a portion of said bill projecting from said first surface, through said plane, and beyond said second surface, whereby said bill portion of said cap is inserted into said pair of slots in order to mount said cap in said support.

6. The support for the removable storage of baseball-style caps as claimed in claim 5, wherein said substantially rigid member is U-shaped.

7. The support for the removable storage of baseball-style caps as claimed in claim 5, wherein said substantially rigid member is in a cylindrical shape.

8. The support for the removable storage of baseball-style caps as claimed in claim 5, wherein said substantially rigid member is a vertical, planar member, and a horizontal support member is attached to said vertical member.

9. The support for the removable storage of baseball-style caps as claimed in claim 8, wherein said vertical and horizontal members are unitary.

* * * * *